US005158128A

United States Patent [19]

Inoue et al.

[11] Patent Number: 5,158,128

[45] Date of Patent: Oct. 27, 1992

[54] THERMOCOUPLE FOR A CONTINUOUS CASTING MACHINE

[75] Inventors: Satoshi Inoue, Kashiwa; Hiroaki Matsumoto, Wakayama, both of Japan

[73] Assignees: Sumitec, Inc., Benton Harbor, Mich.; Sumitomo Metal Industries, Ltd., Tokyo, Japan

[21] Appl. No.: 455,935

[22] Filed: Dec. 18, 1989

Related U.S. Application Data

[63] Continuation of Ser. No. 239,530, Sep. 1, 1988, abandoned.

[51] Int. Cl.[5] ..... B22D 11/16

[52] U.S. Cl. ..... 164/150; 136/221

[58] Field of Search ..... 164/4.1, 150, 154, 451, 164/452; 136/230, 221

[56] References Cited

U.S. PATENT DOCUMENTS

| | | | |
|---|---|---|---|
| 3,681,990 | 8/1972 | Barrett et al. | 136/230 |
| 3,745,828 | 7/1973 | Howell | 164/154 |

FOREIGN PATENT DOCUMENTS

| | | | |
|---|---|---|---|
| 54-26777 | 2/1979 | Japan | 136/221 |
| 59-156558 | 9/1984 | Japan | 164/451 |
| 60-133960 | 7/1985 | Japan | 164/452 |
| 61-232048 | 10/1986 | Japan | 164/150 |

*Primary Examiner*—Kuang Y. Lin
*Attorney, Agent, or Firm*—Baker & Daniels

[57] ABSTRACT

A thermocouple assembly for a continuous casting mold. The assembly includes a hollow body one end of which has external pipe threads whereby the hollow body may be sealingly threaded into a threaded cavity provided in the outer surface area of the mold wall. The hollow body is sealed in the water jacket by means of a sleeve received over the hollow body. A seal is placed between the hollow body and the sleeve and a second seal is placed between the water jacket and the hollow body. A constantan thermocouple is received in the hollow body and is maintained in direct contact with the mold by either a compression spring or by being threaded into the mold.

12 Claims, 4 Drawing Sheets

THERMOCOUPLE FOR A CONTINUOUS CASTING MACHINE

This is a continuation of application Ser. No. 239,530, filed Sep. 1, 1988, which is now abandoned.

BACKGROUND OF THE INVENTION

This invention relates to continuous casting machines and in particular to a thermocouple for monitoring the temperature of the mold in a continuous casting machine.

Continuous casting machines are well known in the prior art and include a mold made up of two essentially parallel wide walls and two essentially parallel narrow walls which cooperate to define a casting passage of rectangular cross section. The size of the continuous slabs formed by the continuous casting method may be up to 12 inches thick and 100 inches wide. The mold is surrounding by a water jacket which cools the mold. Conventionally the mold walls are made of copper plates having high thermal conductivity to permit effective cooling of the mold by water. The back surface of the mold walls which are surrounded by the water jacket are generally grooved to insure more efficient cooling by the cooling water which flows over the back surfaces of the mold walls.

Continuous casting molds are generally arranged vertically whereby the molten metal, which is at a temperature in excess of 2000° F. as it enters the mold, is cooled by the mold so that a skin initially forms around the molten metal and forms a slab. The metal inside the skin will still be molten at this time.

Due to the initial weakness of its skin, the slab must be supported even after it leaves the mold. Thus, a series of support zones are arranged downstream of the mold for supporting the slab as it cools. The slab will progress to a position wherein the slab is cut into sections.

It is very important that the temperature of the mold be accurately monitored so that the mold temperature will not become too high. If the mold temperature becomes too high, a situation called "break-out" occurs in which the skin of the slab, as it emerges from the mold, is too thin and will rupture or break whereby the molten metal inside the slab will pour out through the break and run down through the casting equipment. If this occurs, the entire casting apparatus must be shut down and repaired, thus resulting in costly repairs as well as down time of the continuous casting equipment.

In order to insure that the mold temperature does not become too high, thermocouples have been used in the past to monitor the mold temperature. These thermocouples are sometimes called sticker detectors and are used to sense the temperature of the mold which is at or near the temperature of the slab skin. If an excessive temperature is sensed, the mold is shut down or other action is taken to prevent a break-out from occurring.

Prior art continuous casting mold temperature sensors generally have comprised thermocouples which were immersed in the cooling water inside the water jacket and which contacted the back surface of the mold over which the cooling water was circulated. Thus, such thermocouples have been referred to as "wet" thermocouples. Such thermocouples have commonly been constructed of constantan which is an alloy containing from 50% to 60% copper and from 40% to 50% nickel.

A problem with such prior art "wet" thermocouples has been that the constantan thermocouple tips tend to become contaminated by the build-up of calcium or other impurities contained in the water. This build-up of deposits results in inaccurate readings and potential electrical shorts of the thermocouple, thus resulting in break-outs. Build-up of deposits could also result in a slower response time of the "wet" thermocouple and the resultant occurrence of break-outs. Attempts have also been made to place the thermocouples inside the bolts which hold the mold walls or "coppers" to the water jacket. However such designs permitted water to leak out of the water jacket which problem was aggravated by the thermal expansion and contraction of the coppers.

It is therefore desired to provide a dry thermocouple for a continuous casting mold, thereby eliminating the possibility of contamination of the thermocouple, inaccurate and delayed readings of the thermocouple and break-outs.

SUMMARY OF THE INVENTION

The present invention, in one form thereof, overcomes the disadvantages of the above described prior art thermocouples for continuous casting machines by providing an improved thermocouple therefor.

The thermocouple of the present invention is a dry thermocouple which is sealed from contact with the cooling water. The thermocouple is inserted in a cavity located in a flat surface area of the mold wall and is sealed inside the cavity and held in direct intimate contact with the mold.

The thermocouple assembly, according to the present invention, includes an elongated hollow body having a pipe thread on one end thereof which is threaded into a threaded cavity provided in the mold. The thermocouple is located inside the elongated hollow body and is in direct contact with the mold either by being threaded into the mold or by being urged into contact with the mold by a biasing spring. The hollow body is sealed in the water jacket by means of a sleeve which surrounds the hollow body and a pair of seals such as O-rings disposed respectively between the sleeve and the water jacket and between the sleeve and the hollow body. The sleeve is retained in position by means of a keeper or the like. Thus, water may flow around the hollow body inside a water jacket but cannot leak into the hollow body because the hollow body is sealed to the mold by the pipe threads. Furthermore, water can not leak out of the water jacket because of the sealing of the sleeve to both the hollow body and the water jacket.

An advantage of the present invention is that the thermocouple is positively sealed from contamination by cooling water, thereby eliminating inaccurate readings and preventing break-outs from occurring.

Another advantage of the present invention is that the thermocouple maintains better contact with the mold because of the threaded connection of the thermocouple with the mold.

Still another advantage of the present invention is that in the spring loaded thermocouple embodiment, thermal expansion may be readily accommodated by the spring.

Yet another advantage of the present invention is that it reduces mold maintenance because there is no possibility of contamination of the thermocouples.

A further advantage of the present invention is that by virtue of the use of a dry type thermocouple which is in direct contact with the mold and which is not being cooled by the cooling water which flows around the thermocouple, changes in temperature of the mold are sensed more quickly than was possible with prior art thermocouples.

A still further advantage of the present invention is that the temperature of the mold can be sensed more accurately than was possible with prior art wet thermocouples.

The present invention, in one form thereof, comprises a thermocouple assembly for a continuous casting mold wherein the mold includes a cooling jacket and the mold further includes a plurality of grooves and a planar surface area. The thermocouple assembly comprises an elongated hollow body one end of which is provided with external pipe threads. The planar surface of the mold includes a cavity. The cavity has first internal pipe threads therein for sealingly receiving the threaded one end of the hollow body. The hollow body is disposed in a through aperture in the water jacket. A thermocouple is disposed in the hollow body. One end of the thermocouple extends out of the hollow body into the mold cavity and is in direct contact with the mold. Means are provided for maintaining the thermocouple in direct contact with the mold. A sleeve surrounds the hollow body and is received in the water jacket aperture. A first seal is sealingly disposed between a generally planar end surface of the sleeve and the water jacket. A second seal is sealingly disposed between the sleeve and the hollow body. Means are provided for maintaining the sleeve and the first seal tightly compressed against the water jacket.

The present invention, in one form thereof, comprises a thermocouple assembly for a continuous casting mold wherein the mold includes a water cooling jacket. The assembly includes an elongated hollow body one end of which is provided with pipe threads. A cavity is provided in the mold. The cavity has first internal threads therein for sealingly receiving the threaded end of the hollow body. The hollow body is disposed in a through aperture in the water jacket. A thermocouple is disposed in the hollow body, one end of the thermocouple extending out of the hollow body into the mold cavity and being in direct contact with the mold. Means are provided for maintaining the thermocouple in direct contact with the mold. A sleeve is disposed around the hollow body and first sealing means is disposed between the sleeve and the hollow body for preventing cooling water from passing therebetween. A second sealing means is disposed between the sleeve and the water jacket for preventing cooling water from passing therebetween.

The present invention, in one form thereof, comprises a temperature sensing apparatus for a continuous casting machine which includes a mold and a water cooling jacket therefor. The temperature sensing apparatus includes an elongated hollow body and a cavity in the mold for sealingly receiving one end of the hollow body. The hollow body is disposed in a through aperture in the water jacket. A thermocouple is disposed in the hollow body and has one end thereof in direct contact with the mold. Means are provided for maintaining the thermocouple in direct contact with the mold. Means are operatively associated with the hollow body for sealing the hollow body in the through aperture and preventing water from escaping from the water jacket.

It is an object of the present invention to provide a dry thermocouple for a continuous casting mold.

It is another object of the present invention to provide a dry thermocouple for a continuous casting mold which is held in direct contact with the mold.

Still another object of the present invention is to provide a dry thermocouple which is not subject to contamination and/or potential failure because of the occurrence of contamination of the thermocouple.

Yet another object of the present invention is to provide a thermocouple for a continuous casting mold which senses changes in mold temperature more quickly than was possible with prior art thermocouples.

Yet still another object of the present invention is to provide a dry thermocouple for a continuous casting mold which senses changes in mold temperature more accurately than was previously possible with prior art thermocouples.

BRIEF DESCRIPTION OF THE DRAWINGS

The above mentioned and other features and objects of this invention and the manner of attaining them will become more apparent and the invention itself will be better understood by reference to the following description of an embodiment of the present invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 11:
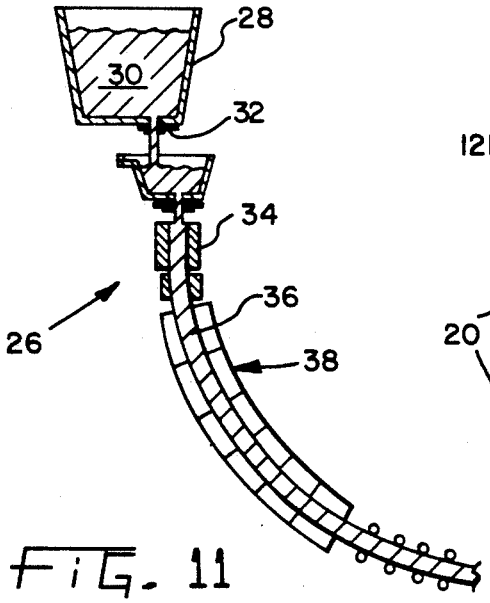
FIG. 11 is an elevational diagrammatic view of a continuous casting apparatus.
Figure 10:
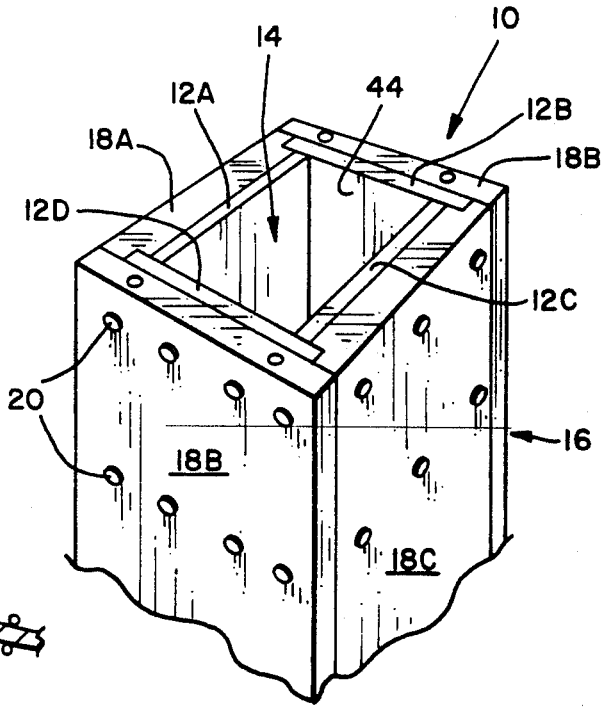
FIG. 10 is a broken away perspective view of a continuous casting mold and water jacket assembly.

Referring now to FIGS. 10 and 11, there is shown a mold assembly 10 having mold walls **12*a* through 12*d* which form a rectangular mold cavity 14. The mold is surrounded by a water jacket 16 consisting of four water jacket walls 18*a* through 18*d*. Water jacket walls 18 are bolted to mold walls 12 by means of bolts 20**.

FIG. 11 shows a casting apparatus 26 including a ladle 28 which contains molten metal 30. The molten metal is poured from the ladle through a gate 32 into mold 34. Mold 34 is at a lower temperature than molten steel 30. Typically the steel in its molten state will be at a temperature of approximately 2700° F. and mold 34 will be maintained at a temperature of approximately 800° F. by means of the cooling water which flows through water cooling jacket 18. Thus, the external surface of the metal in mold 34 will form a skin whereas the center of the slab 36 may still be molten as the slab progresses through mold 34. After exiting from mold 34, a roller apron 38 gradually bends the slab 36, permits the slab to cool further and guides the slab to a position where the slab is cut into sections (not shown).

Figure 6:
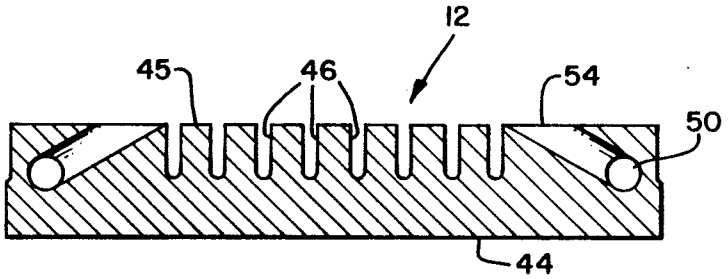
FIG. 6 is a cross sectional view of the mold wall of FIG. 5 taken along lines 6—6 thereof.
Figure 5:
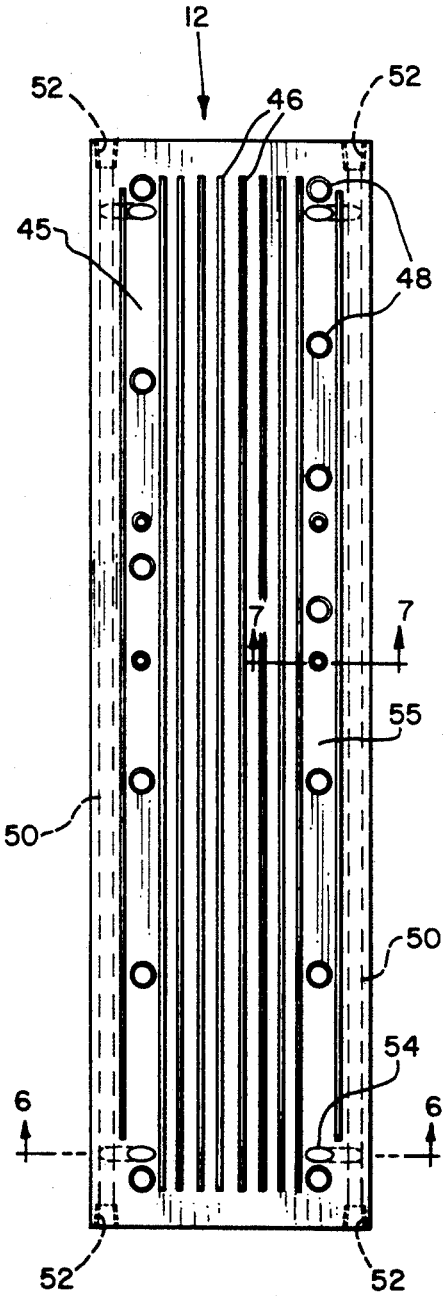
FIG. 5 is a reduced scale elevational view of the rear side of a mold wall for a continuous casting machine.

Referring now to FIGS. 5 and 6, one of the mold walls 12 is shown in greater detail. The wall 12 is essentially a copper plate. The outside surface 45 of the wall 12 is provided with a series of longitudinal grooves 46. These grooves 46 are provided for cooling purposes and increase the surface area of the wall which is contacted by cooling water. Grooves 46 also provide for more efficient cooling of the mold because the water will contact wall 12 for some depth whereby the heat to be transferred travels through a smaller section of wall 12. Wall 12 is customarily made from copper to provide good thermal conductivity, thus permitting efficient cooling of the mold. Surface 44 of wall 12 is located inside the mold cavity and is therefore contacted by the molten steel. Surface 44 may be plated with various metals such as for instance disclosed in U.S. Pat. No. 4,037,646 entitled "Molds for Continuously Casting Steel" which disclosure is incorporated herein by reference.

Axial water passages 50 are also provided in wall 12 and are provided with threaded apertures 52 for connection to a water conduit (not shown). Thus water may travel through outlet 54, through water passage 50, and exit outlets 52.

Wall 12 is provided with a series of threaded apertures 48 for receiving the threaded ends of bolts 20 which secure the water jacket to the mold. Space is provided between the walls 18 of the water jacket and walls 12 of the mold. Water is supplied to flow through this space and cool the mold.

Figure 7:
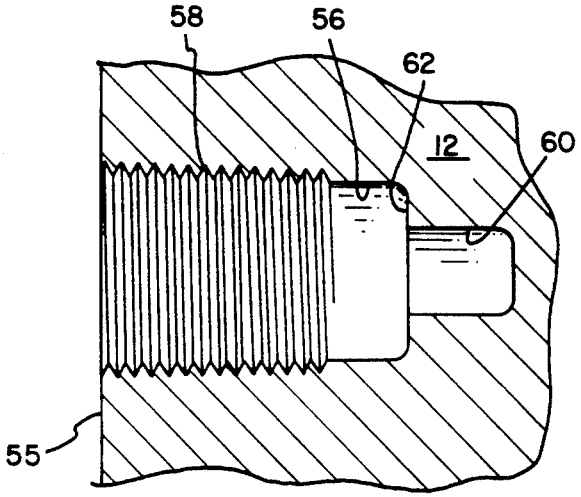
FIG. 7 is a partial enlarged cross sectional view of a portion of the mold wall shown in FIG. 1.

As best seen in FIGS. 5 and 7, flat surface portion 55 of wall 12 includes a cavity 56 which is provided with internal pipe threads 58 in one end thereof. A second cavity 60 of a smaller diameter than cavity 56 connects with cavity 56 and forms shoulder 62 therewith.

Figure 4:
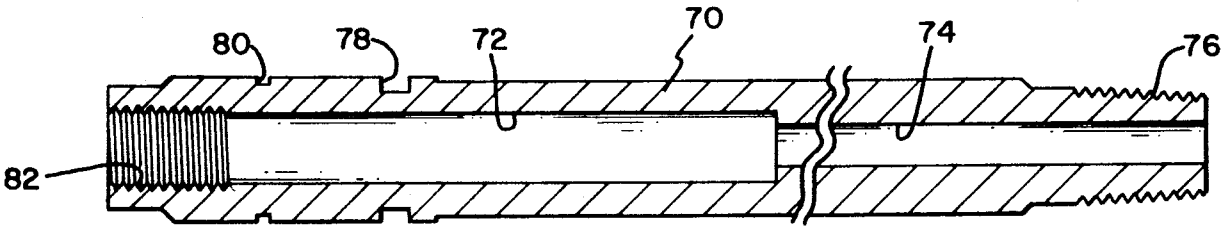
FIG. 4 is an enlarged cross sectional view of the hollow body of the thermocouple assembly of FIG. 1.

Referring now to FIG. 4, there is shown a hollow elongated body 70 which includes an aperture 74 part of which forms a pocket 72 having a larger diameter than aperture 74. The hollow body is provided at one end with external pipe threads 76 and at its other end with internal threads 82. Lastly, the hollow body includes a pair of annular grooves 78 and 80 for purposes further described hereinafter.

Figure 1:
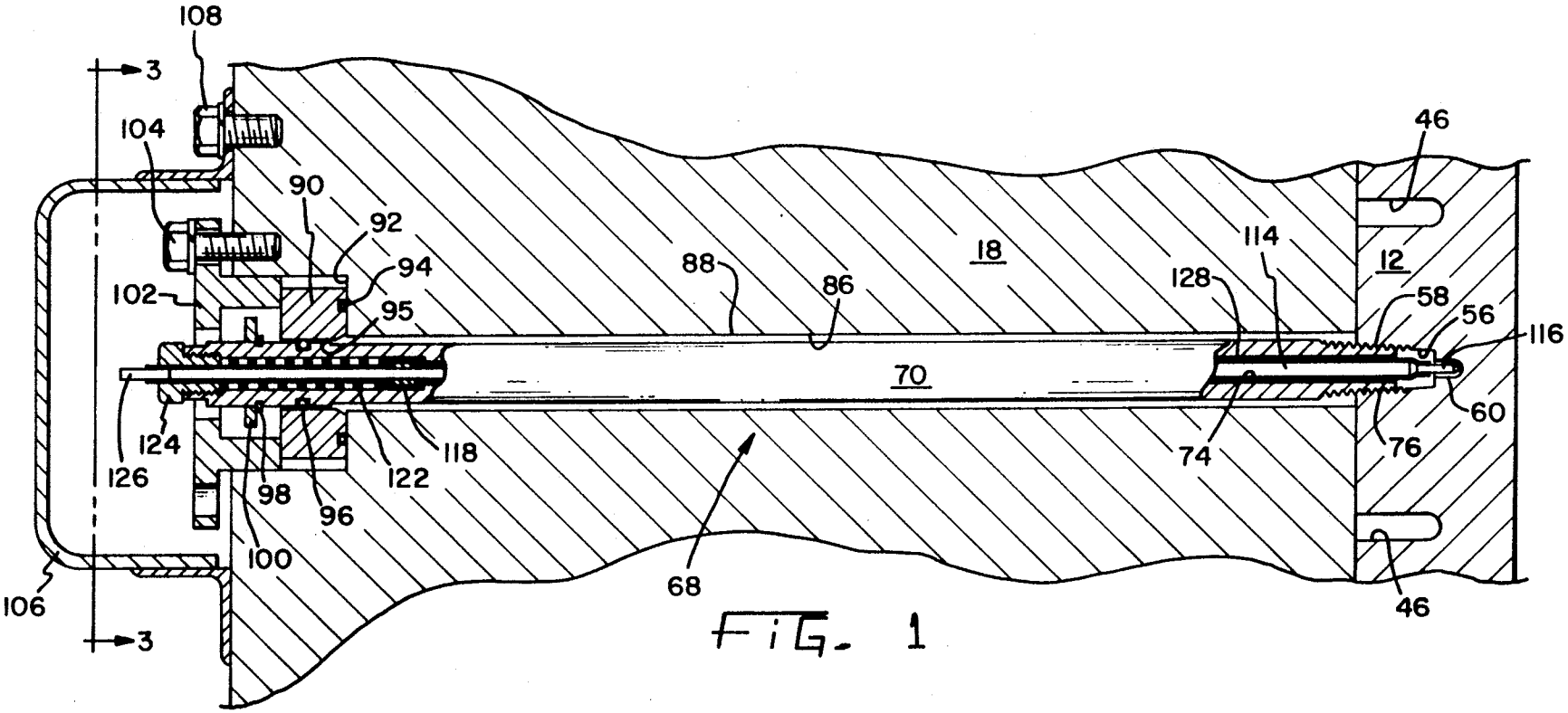
FIG. 1 is an elevational cross sectional view of the thermocouple assembly according to the present invention.
Figure 9:
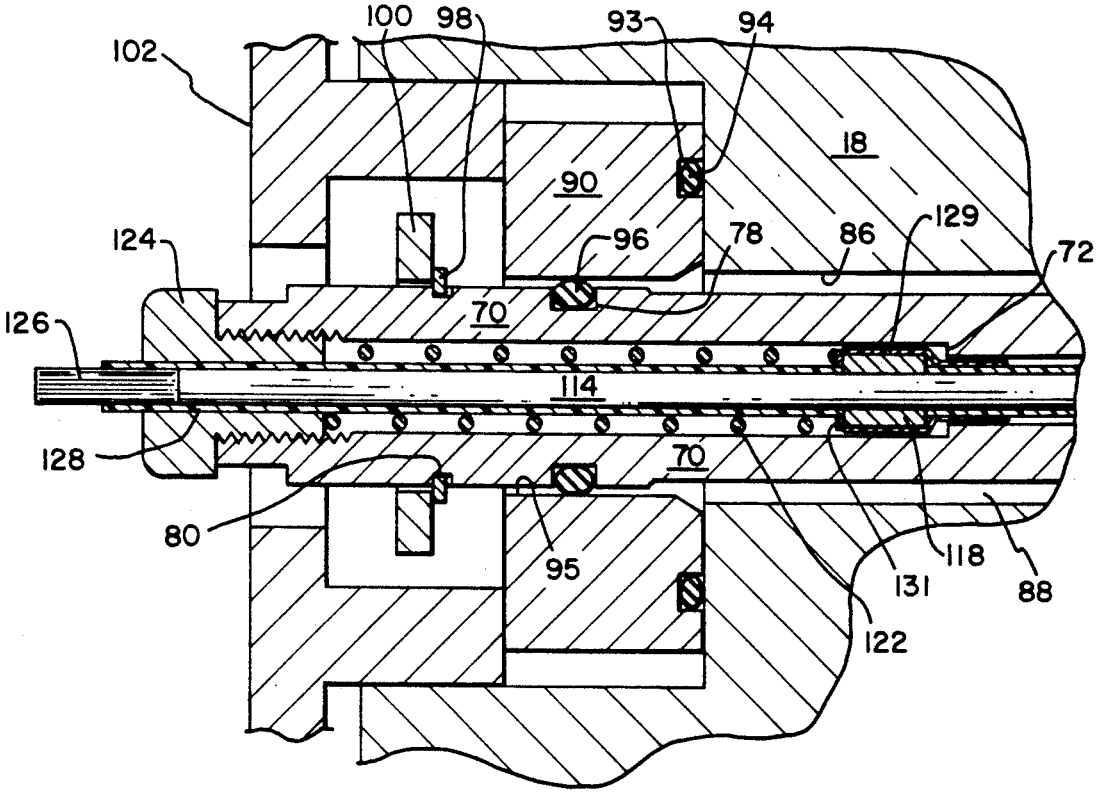
FIG. 9 is an enlarged, broken-away cross sectional view of the thermocouple assembly of FIG. 1.

Referring now to FIGS. 1 and 9 which shows the thermocouple assembly 68, it can be seen that the hollow body 70 is threaded into pipe threads 58 of cavity 56 in mold wall 12. By virtue of using pipe threads, hollow body 70 is sealingly connected with wall 12. Hollow body 70 also extends through an aperture 86 in water jacket wall 18. Space 88 is provided between thermocouple 70 and water jacket 18 so that water can flow through space 88 and cool the thermocouple assembly.

A sleeve 90 receives body 70 and abuts against a shoulder 92 of the aperture in water jacket wall 18. An annular groove 93 is provided in sleeve 90 in which is received a seal or O-ring 94. Thus O-ring 94 seals sleeve 90 to water jacket wall 18 so that water cannot escape from space 88 through the space between water jacket wall 18 and sleeve 90. Annular groove 78 in hollow body 70 is provided with a seal or O-ring 96 which seats against the inside of through aperture 95 of sleeve 90, thereby sealing sleeve 90 against hollow body 70. Thus no water can escape from space 88 through the space between sleeve 90 and body 70. It should be noted that, while seals 94 and 96 have been shown as O-rings, other suitable forms of seals may also be used.

Figure 2:
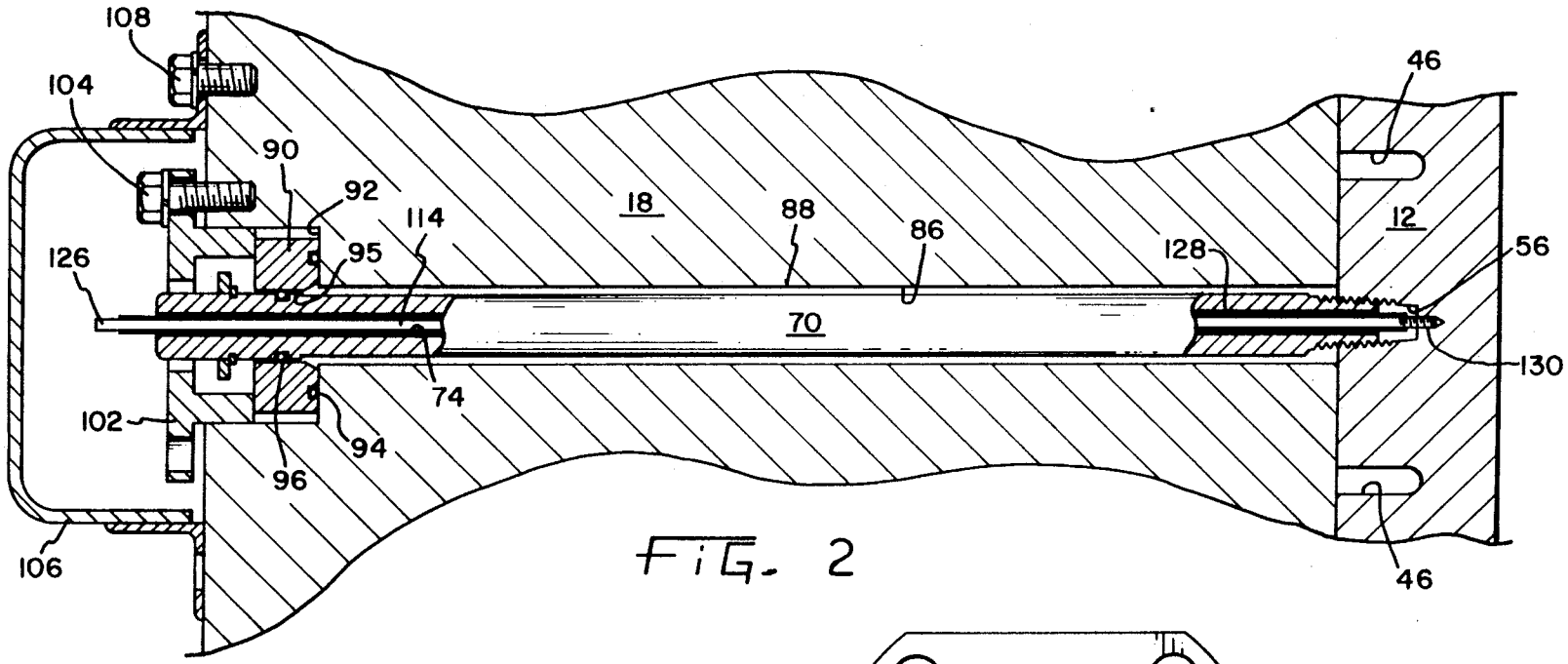
FIG. 2 is an elevational cross sectional view of another embodiment of the thermocouple assembly according to the present invention.
Figure 3:
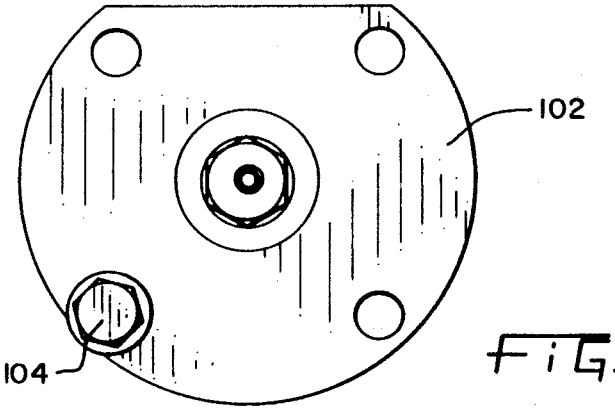
FIG. 3 is an end view of the thermocouple assembly of FIG. 1 taken along line 3—3 thereof.

Retaining ring 98 is provided in annular groove 80 of hollow body 70 and a washer 100 abuts thereagainst for purposes further explained hereinafter. Hollow body 70 is retained in water jacket wall 18 by means of a circular flange 102 as best seen in FIG. 2, 3 and 9. Flange 102 is bolted to water jacket wall 18 by means of bolts 104. One end of flange 102 abuts against sleeve 90 which in turn abuts against water jacket wall 18. Thus sleeve 90 is tightly pressed against shoulder 92 thereby causing O-ring 94 to be depressed and creating a positive seal with water jacket wall 18. The relatively close fit between sleeve 90 and hollow body 70 and the use of O-ring 96 causes thermocouple body 70 to stay in place. Sleeve 102 also serves to prevent the thermocouple assembly 68 from being ejected by the force of the pressurized water if it should break off at the mold wall 12. If this situation should occur then thermocouple body 70 can only travel to the left as seen in FIGS. 1 and 9 until washer 100 abuts against circular flange 102. The interference between washer 100 and retaining ring 98 prevents any further travel of the thermocouple assembly toward the left as seen in FIGS. 1 and 9.

A cover 106 is also provided for the assembly. Cover 106 is bolted to water jacket wall 18 by means of bolts 108 and protects the end of the thermocouple assembly.

The thermocouple preferably consists of a constantan rod 114. Other types of thermocouples may also be used. However, other thermocouples have the disadvantage of having two electrical leads. By having a multiplicity of leads it is possible that some of the electrical leads may break off which is, of course, undesirable. By using constantan material, a voltage is produced at the junction of the constantan tip 116 with the copper mold wall 12. This voltage is indicative of the temperature of the junction and therefore of mold wall 12. The grounding path for the thermocouple circuit is provided through the copper mold wall 12 and water jacket 18. The fit of constantan rod 114 in aperture 74 is relatively loose to provide for thermal expansion of the various elements.

The tip 116 of the constantan rod 114 extends into cavity 60 of mold wall 12. Tip 116 is provided with a pointed end to provide for direct and intimate contact of the constantan with wall 12. In FIG. 1, the constantan is kept in intimate contact with wall 12 by means of a spring 122 which seats against a sleeve 118 which is brazed to constantan rod 114. The other end of spring 122 seats against a bolt 124 which is threaded into the end of hollow body 70 as best seen in FIG. 9. Thus, the constantan rod 114 is resiliently urged into direct and intimate contact with mold wall 12 at all times. Even during thermal expansion and contraction of the mold and thermocouple assembly, spring 122 insures that good contact is maintained between the tip 116 of constantan rod 114 with copper mold wall 12. Shrink tubing or other suitable insulating material 128 is slipped over constantan rod 114 to insulate constantan rod 114 and prevent contact thereof with hollow body 70. Suitable insulating material 129 such as shrink tubing is also placed over sleeve 118 to insulate the sleeve from contact with hollow body 70. An insulating washer 131 is placed against the left hand side of sleeve 128 to insulate the sleeve from contact with spring 122.

Figure 8:
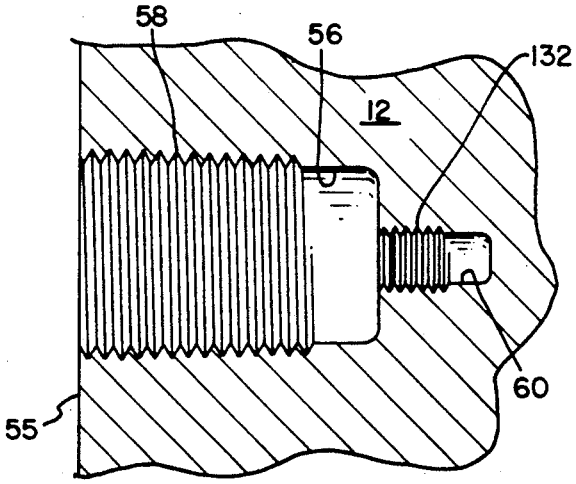
FIG. 8 is a partial cross sectional view of a portion of the mold wall shown in FIG. 2.

In an alternative embodiment shown in FIGS. 2 and 8, the tip 116 of the constantan is provided with threads 130. Cavity 60 is also provided with internal threads 132. Thus constantan rod 114 is threaded into cavity 60 to maintain direct and intimate contact therewith. By using this arrangement, spring 122 may be eliminated.

The other end of constantan rod 114 is provided with a tip 126 for connection to an electrical control circuit which processes the indicated voltage provided by the constantan. A terminal 126 is silver soldered to constantan rod 114 for connection to the control circuit.

Thus what has been provided is a dry type thermocouple sticker detector for large molds which is not contacted by the cooling water in the cooling jacket of the mold. Furthermore, what has been provided is a thermocouple which always remains in direct and intimate contact with the mold thereby providing more accurate reading of the temperatures of the mold and preventing break-outs and cracks from occurring in the slab skin. Lastly, by virtue of the arrangement of sleeve 90 and the O-ring seals 94 and 96, no water can leak out of the thermocouple assembly and water jacket despite changes in dimension of the various mold elements because of thermal expansion and contraction.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A thermocouple assembly for use in a continuous casting mold, said thermocouple assembly comprising:

an elongated hollow body, one end of said hollow body including pipe threads thereon;

a thermocouple disposed in said hollow body, said thermocouple including a contacting end extending out of said one threaded end of said hollow body;

a sleeve disposed around said hollow body;

a first seal received between said sleeve and said hollow body; and means in said hollow body for resiliently biasing said thermocouple contacting end out of said threaded end of said hollow body.

2. The thermocouple assembly of claim 1 wherein said contacting end of said thermocouple is threaded.

3. The apparatus according to claim 2 wherein said thermocouple is composed of constantan.

4. The apparatus according to claim 1 wherein said thermocouple is encased in insulating material.

5. A mold for a continuous casting machine, said mold including a wall with a cavity therein, a water cooling jacket having a through aperture aligned with said cavity, and a temperature sensing apparatus including an elongated hollow body, one end of said hollow body having external pipe threads thereon, said cavity including first internal threads for threadedly engaging said one end of said hollow body whereby the interior of said hollow body is sealed from cooling water, said hollow body disposed in said through aperture; a thermocouple disposed in said hollow body, one end of said thermocouple extending away from said one end of said hollow body into said cavity and being in direct contact with said mold wall;

means for maintaining said thermocouple in direct contact with said mold wall; and means operatively associated with said hollow body for sealing said hollow body in said through aperture and preventing water from escaping from said water jacket whereby said thermocouple is sealed from contact with cooling water.

6. The apparatus according to claim 5 wherein said means for sealing comprises a sleeve, said hollow body received in said sleeve and a first strip of sealing material disposed between said sleeve and said water jacket.

7. The apparatus according to claim 6 including a second strip of sealing material disposed between said hollow body and said sleeve.

8. The apparatus according to claim 5 wherein said means for maintaining said thermocouple in direct contact with the mold wall comprises second internal threads in said cavity, one end of said thermocouple end cooperating with said second internal threads for maintaining direct contact of said thermocouple with said mold wall.

9. The apparatus according to claim 5 wherein said thermocouple is encased in insulating material.

10. The apparatus according to claim 5 wherein said means for maintaining said thermocouple in direct contact with the mold comprises a spring received in said hollow body, shoulder means on said thermocouple in contact with one end of said spring, and means for compressing said spring to thereby resiliently urge said thermocouple into contact with said mold.

11. The apparatus according to claim 5 wherein said thermocouple is composed of constantan.

12. The apparatus according to claim 5 wherein said cavity is located in flat outer surface area of said mold wall.

* * * * *